US008288714B2

(12) United States Patent
Makarov et al.

(10) Patent No.: US 8,288,714 B2
(45) Date of Patent: Oct. 16, 2012

(54) ION TRAPPING

(75) Inventors: Alexander A. Makarov, Bremen (DE); Eduard V. Denisov, Bremen (DE); Gerhard Jung, Delmenhorst (DE); Robert Malek, Lilienthal (DE); Oliver Lange, Bremen (DE)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 12/944,357

(22) Filed: Nov. 11, 2010

(65) Prior Publication Data

US 2011/0057099 A1 Mar. 10, 2011

Related U.S. Application Data

(63) Continuation of application No. 11/909,850, filed on Sep. 27, 2007, now Pat. No. 7,847,243.

(30) Foreign Application Priority Data

Mar. 29, 2005 (GB) ..... 0506287.2

(51) Int. Cl.
*H01J 49/00* (2006.01)

(52) U.S. Cl. ..... 250/283; 250/281; 250/282

(58) Field of Classification Search ..... None
See application file for complete search history.

(56) References Cited

U.S. PATENT DOCUMENTS

| | | | | |
|---|---|---|---|---|
| 3,935,452 | A * | 1/1976 | Prince | 250/283 |
| 5,420,425 | A * | 5/1995 | Bier et al. | 250/292 |
| 5,572,035 | A * | 11/1996 | Franzen | 250/396 R |
| 6,294,780 | B1 * | 9/2001 | Wells et al. | 250/288 |
| 6,674,071 | B2 * | 1/2004 | Franzen et al. | 250/292 |
| 6,781,117 | B1 * | 8/2004 | Willoughby et al. | 250/281 |
| 6,909,089 | B2 * | 6/2005 | Londry et al. | 250/282 |
| 7,157,698 | B2 * | 1/2007 | Makarov et al. | 250/281 |
| 2002/0092980 | A1 * | 7/2002 | Park | 250/288 |
| 2002/0121594 | A1 * | 9/2002 | Wang et al. | 250/281 |
| 2003/0136905 | A1 * | 7/2003 | Franzen et al. | 250/292 |
| 2003/0141447 | A1 * | 7/2003 | Verentchikov et al. | 250/287 |
| 2003/0160169 | A1 * | 8/2003 | Baba et al. | 250/292 |
| 2004/0011956 | A1 * | 1/2004 | Londry et al. | 250/292 |
| 2004/0222369 | A1 * | 11/2004 | Makarov et al. | 250/281 |
| 2005/0098719 | A1 * | 5/2005 | Thomson | 250/288 |
| 2005/0139760 | A1 * | 6/2005 | Wang et al. | 250/281 |
| 2005/0199804 | A1 * | 9/2005 | Hunt et al. | 250/290 |
| 2005/0263695 | A1 * | 12/2005 | Syka | 250/291 |
| 2006/0076484 | A1 * | 4/2006 | Brown et al. | 250/290 |
| 2007/0023629 | A1 * | 2/2007 | Makarov | 250/282 |

FOREIGN PATENT DOCUMENTS

| | | | |
|---|---|---|---|
| EP | 290712 | A1 * | 11/1988 |
| WO | WO 97/07530 | A1 | 2/1997 |
| WO | WO 9707530 | A1 * | 2/1997 |

* cited by examiner

*Primary Examiner* — Bernard E Souw
*Assistant Examiner* — Andrew Smyth
(74) *Attorney, Agent, or Firm* — Charles B. Katz

(57) ABSTRACT

This invention relates to a method of trapping ions and to an ion trapping assembly. In particular, the present invention has application in gas-assisted trapping of ions in an ion trap prior to a mass analysis of the ions in a mass spectrometer. The invention provides a method of trapping ions in a target ion trap of an ion trapping assembly that comprises a series of volumes arranged such that ions can traverse from one volume to the next, the volumes including the target ion trap, whereby ions are allowed to pass repeatedly through the volumes such that they also pass into and out from the target ion trap without being trapped. Potentials may be used to reflect the ions from respective ends of the ion trapping assembly. Optionally, a potential well and/or gas-assisted cooling may be used to cause the ions to settle in the target ion trap.

7 Claims, 3 Drawing Sheets

ION TRAPPING

CROSS-REFERENCE TO RELATED APPLICATIONS

The present application is a continuation under 35 U.S.C. §120 and claims the priority benefit of co-pending U.S. patent application Ser. No. 11/909,850, filed Sep. 27, 2007, which is a National Stage application under 35 U.S.C. §371 of PCT Application No. PCT/GB2006/001170, filed Mar. 29, 2006, which claims the priority benefit of UK application No. 0506287.2 filed Mar. 29, 2005. The disclosures of each of the foregoing applications are incorporated herein by reference.

FIELD OF THE INVENTION

This invention relates to a method of trapping ions and to an ion trapping assembly. In particular, the present invention has application in gas-assisted trapping of ions in an ion trap prior to a mass analysis of the ions in a mass spectrometer.

BACKGROUND OF THE INVENTION

Such ion traps may be used in order to provide a buffer for an incoming stream of ions and to prepare a packet with spatial, angular and temporal characteristics adequate for the specific mass analyser. Examples of mass analysers include single- or multiple-reflection time-of-flight (TOF), Fourier transform ion cyclotron resonance (FT ICR), electrostatic traps (e.g. of the Orbitrap type), or a further ion trap.

A block diagram of a typical mass spectrometer with an ion trap is shown in FIG. 1. The mass spectrometer comprises an ion source that generates and supplies ions to be analysed to a single ion trap where the ions are collected until a desired quantity are available for subsequent analysis. A first detector may be located adjacent to the ion trap so that mass spectra may be taken, under the direction of the controller. The mass spectrometer as a whole is also operated under the direction of the controller. The mass spectrometer is generally located within a vacuum chamber provided with one or more pumps to evacuate its interior.

Now Ion storage devices that use RF fields for transporting or storing ions have become standard in mass spectrometers, such as the one shown in FIG. 1. FIG. 2*a* shows a typical arrangement of four electrodes in a linear ion trap device that traps ions using a combination of DC, RF and AC fields. The elongate electrodes extend along a z axis, the electrodes being paired in the x and y axes. As can be seen from FIG. 2*a*, each of the four elongate electrodes is split into three along the z axis.

FIGS. 2*b* and 2*c* show typical potentials applied to the electrodes. Trapping within the storage device is achieved using a combination of DC and RF fields. The electrodes are shaped to approximate hyperbolic equipotentials and they create a quadrupolar RF field that assists in containing ions entering or created in the trapping device. FIG. 2*c* shows that like RF potentials are applied to opposed electrodes such that the x axis electrodes have a potential of opposite polarity to that of the y axis electrodes. This trapping is assisted by applying elevated DC potentials to the short end sections of each split electrode relative to the longer centre section. This superimposes a potential well on the RF field.

AC potentials may also be applied to the electrodes to create an AC field component that assists in ion selection.

Once trapped, ions may be later ejected to a mass analyser either axially from an end of the ion trap or orthogonally through an aperture provided centrally in one of the electrodes.

This type of ion trap is described in further detail in U.S. Pat. No. 5,420,425.

The ion trap may be filled with a gas such that trapping of ions is assisted by the ions losing their initial kinetic energy in low-energy collisions with the gas. After losing sufficient energy, ions are trapped within the potential well formed within the ion trap. Those ions not trapped during the first pass are normally lost to the adjacent ion optics.

For most ions, over a wide range of masses and structures, substantial loss of kinetic energy occurs when the product of gas pressure and distance travelled by the ions (P×D) exceeds around 0.2 to 0.5 mm Torr. Most practical 3D and linear ion traps operate at pressures of around 1 mTorr or lower. This places a requirement for an ion trap of 100 to 150 mm length to provide a sufficiently long path length to avoid excessive ion loss. However, such long ion traps are undesirable because, for example, they result in excessively stringent manufacturing requirements. So practical ion traps have to compromise between the efficiency of ion capture and the length of the system.

SUMMARY

Against the background, and from a first aspect, the present invention resides in a method of trapping ions in a target ion trap comprising: introducing ions into an ion trapping assembly comprising a series of volumes arranged such that ions can traverse from one volume to the next, the volumes including the target ion trap; allowing the ions to pass into, through and out from the target ion trap without being trapped; and guiding the ions such that they pass into the target ion trap for a second time.

This invention makes use of the realisation that under certain ion-optical conditions, this compromise could be avoided by providing multiple passes of ions through the series of volumes, wherein ion losses are low on each pass. Trapping within one of the volumes occurs only at the last stages when ion kinetic energy becomes so low that the ions cannot leave that volume anymore. If multiple volumes are used, the volume where ions need to be finally stored could be called the "target ion trap".

The volumes are intended to correspond to discrete parts, e.g. to an ion trap, ion reflectors, ion optics (that merely serve to guide ions as they pass therethrough), etc. Some parts may be composite and comprise more than a single volume. For example, the target ion trap may comprise a single volume or may comprise a pair of trapping volumes separated by an electrode. A voltage on the electrode could be switched on and off to create a single trapping volume or a pair of trapping volumes. The ion trapping assembly may be part of a larger collection of ion handling parts, e.g. it may be a component of an apparatus comprising an ion source, further ion traps or stores, ion optics, etc.

Providing an ion trapping assembly comprising a target ion trap and other volumes means that the ions may lose energy while traversing a path that is longer than the length of just the target ion trap. This yields a P×D (where D is the length of the target ion trap) much less than 0.2-0.5 mm Torr. Ensuring the ions return to the target ion trap means that the ions can be collected therein.

Conveniently, the method may comprise reflecting the ions such that they pass into the target ion trap for the second time and, optionally, reflecting the ions a second time such that the ions pass into the target ion trap for a third time. This may be achieved by placing a first potential at one end of the ion trapping assembly and placing a second potential at the other end of the ion trapping assembly, thereby causing the ions to reflect at either end and so to traverse the target ion trap repeatedly. In this way the ions repeatedly traverse the ion trapping assembly, providing a far greater path length over which they may lose energy. This is especially useful for heavier peptides and proteins which normally require longer stopping paths (in extreme cases, up to tens of reflections).

Optionally, RF potentials may be applied to the ends of ion trapping assembly, causing ions to be trapped by a so-called "pseudo-potential" or "effective potential". This pseudo-potential exhibits a high mass dependence, and may be used to trap ions of both positive and negative polarity simultaneously.

In order to ensure that the ions are trapped within the target ion trap, it is preferred to apply potentials to the ion trapping assembly such that, for positive ions, the target ion trap is at the lowest potential among all gas-filled volumes, thereby forming a potential well. In this way, ions will tend to settle in the target ion trap as they lose energy. On the other hand, volumes within the ion trapping assembly with negligible number of collisions per pass (i.e. volumes sustained at considerably better vacuum) do not have such restrictions: their potentials could be lower or higher than that of the target trap.

Optionally, the target ion trap comprises first and second volumes of the series of volumes, the method comprising applying potentials to the ion trapping assembly such that the potential rises at either end of the target ion trap thereby forming a potential well, and such that potential barriers are formed at either end of the ion trapping assembly; introducing ions into the ion trapping assembly where they are subsequently reflected by the potential barriers at either end of the ion trapping assembly, thereby traversing the target ion trap repeatedly while they lose energy eventually to settle in the target ion trap; and subsequently to apply a potential to act between the first and second volumes thereby to split the ions that have settled in the target ion trap into two groups, one being trapped in the first volume and the other being trapped in the second volume.

Such a method provides a convenient way of trapping two or more ion bunches. The ion bunches may then be treated separately (e.g. sent to different mass spectrometers) or may be treated in the same fashion (e.g. sent to the same detector as a pair of subsequent packets). This method may provide improved cross-calibration of detectors and better quantitative analysis.

The first and second volumes may be adjacent one another. For example, the target ion trap may comprise two volumes separated by a trapping potential placed therebetween. An electrode that extends around the perimeter of the ion trap may be used to provide this potential. Alternatively, the first and second volumes may be separated by a further volume or volumes, such as an ion guide. In this sense, the target ion trap is composite and comprises two separate ion traps. When the ion bunch is to be split, the potential of the dividing volume may be raised relative to the first and second volumes, thereby creating potential wells in the first and second volumes.

From a second aspect, the present invention resided in a method of trapping ions in a target ion trap of an ion trapping assembly comprising a series of volumes arranged such that ions can traverse from one volume to the next, the volumes including the target ion trap, the method comprising: applying potentials to the ion trapping assembly such that (i) the potential rises at either end of the target ion trap, thereby forming a potential well in the target ion trap, (ii) the one or more volumes adjacent the target ion trap are at a higher potential than the target ion trap, and (iii) potential barriers are formed at either end of the ion trapping assembly; and introducing ions into the ion trapping assembly where they are subsequently reflected by the potential barriers at either end of the ion trapping assembly, thereby traversing the target ion trap repeatedly to settle in the potential well as their energy decreases.

Optionally, the method may further comprise introducing a gas into at least one of the volumes thereby causing gas-assisted trapping of the ions. This represents a preferred method of assisting energy loss of the ions such that they settle in the potential well formed in the target ion trap. A pressure range of 0.1 mTorr to 10 mTorr is preferred, 0.5 mTorr to 2 mTorr being preferred still further.

Optionally, the method may further comprise introducing a gas into a volume adjacent the target ion trap. Preferably, the gas or gases are introduced into the target ion trap and the adjacent volume in such a way that the pressure in the target ion trap is lower than in the adjacent volume.

According to one contemplated embodiment, the method may further comprise trapping ions in an ion store before releasing ions from the ion store into the ion trapping assembly. Optionally, the method may comprise repeatedly trapping ions in the ion store and releasing them into the ion trapping assembly thereby to increase successively the number of ions that finally settle in the target ion trap.

Optionally, the ion trapping assembly has a longitudinal axis corresponding broadly to the ions' motion backwards and forwards through the series of volumes and the method further comprising ejecting ions trapped in the target ion trap substantially orthogonally from the ion trap. The ions may be ejected, for example, into the entrance of a mass analyser such as an electrostatic (Orbitrap) type analyser or single- or multi-reflection time-of-flight mass analyser. A curved target ion trap may be used to assist in focussing ions ejected orthogonally therefrom.

From a third aspect, the present invention resides in an ion trapping assembly comprising: a series of volumes arranged such that ions can traverse from one volume to the next, the volumes including a target ion trap; electrodes arranged to carry potentials; and a controller arranged to set potentials on the electrodes such that (i) the potential rises at either end of the target ion trap, thereby forming a potential well in the target ion trap, (ii) the one or more volumes adjacent the target ion trap are at a higher potential than the target ion trap, and (iii) potential barriers are formed at either end of the ion trapping assembly.

Optionally, the ion trapping assembly may comprise ion optics corresponding to one of the volumes located adjacent the target ion trap or may comprise an ion reflector corresponding to one of the volumes located adjacent to the target ion trap.

The present invention also extends to an ion source and trapping assembly, comprising an ion source, an optional ion store positioned downstream of the ion source, and an ion trapping assembly as described above positioned downstream. The controller may be arranged to set potentials on the ion store to trap ions produced by the ion source and then to release trapped ions into the ion trapping assembly. As ion sources (e.g. electrospray) frequently contain regions of higher pressure (e.g. atmosphere-to-vacuum interface with differential pumping and voltages forcing ions through it), these regions could in fact be a part of the ion trapping assembly such that they form one or more of the volumes through which the ions are multiple-reflected before settling in the target ion trap.

The present invention also extends to a mass spectrometer comprising an ion trapping assembly or ion source and trapping assembly as described above.

BRIEF DESCRIPTION OF THE DRAWINGS

In order that the invention may be more readily understood, reference will now be made, by way of example only, to the following drawings, in which.

DETAILED DESCRIPTION OF THE EMBODIMENTS

Figure 1:
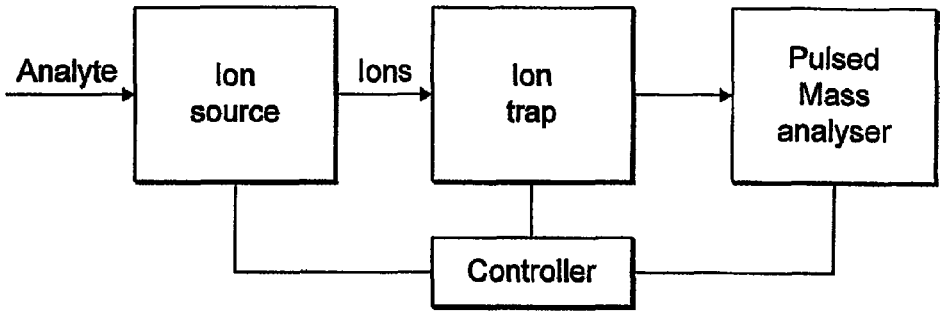
FIG. 1 is a block diagram representation of a mass spectrometer.
Figure 2A:
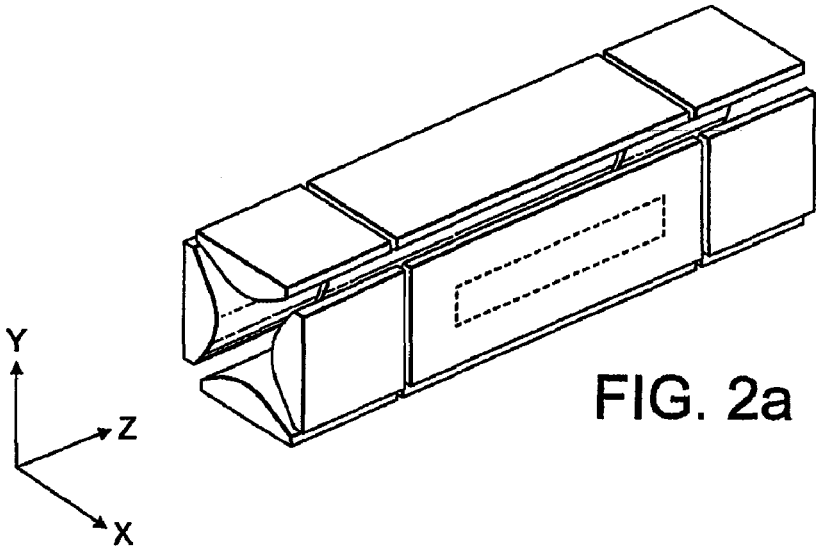
FIG. 2*a* is a representation of a linear quadrupole ion trap and FIGS. 2*b* and 2*c* illustrate the DC, AC and RF potentials used for operation of the ion trap.
Figure 2B:
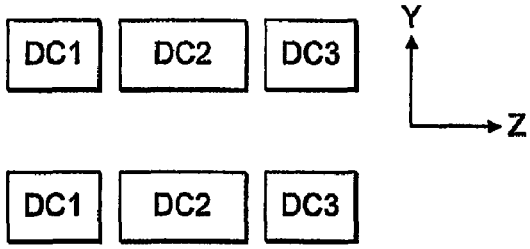
Figure 2C:
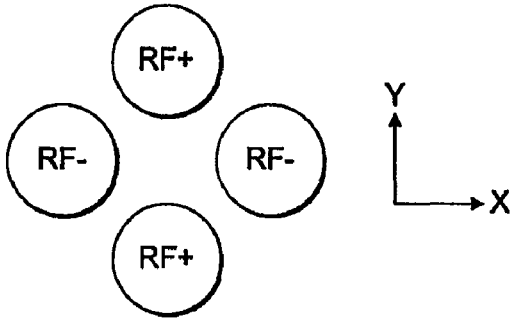
Figure 3B:
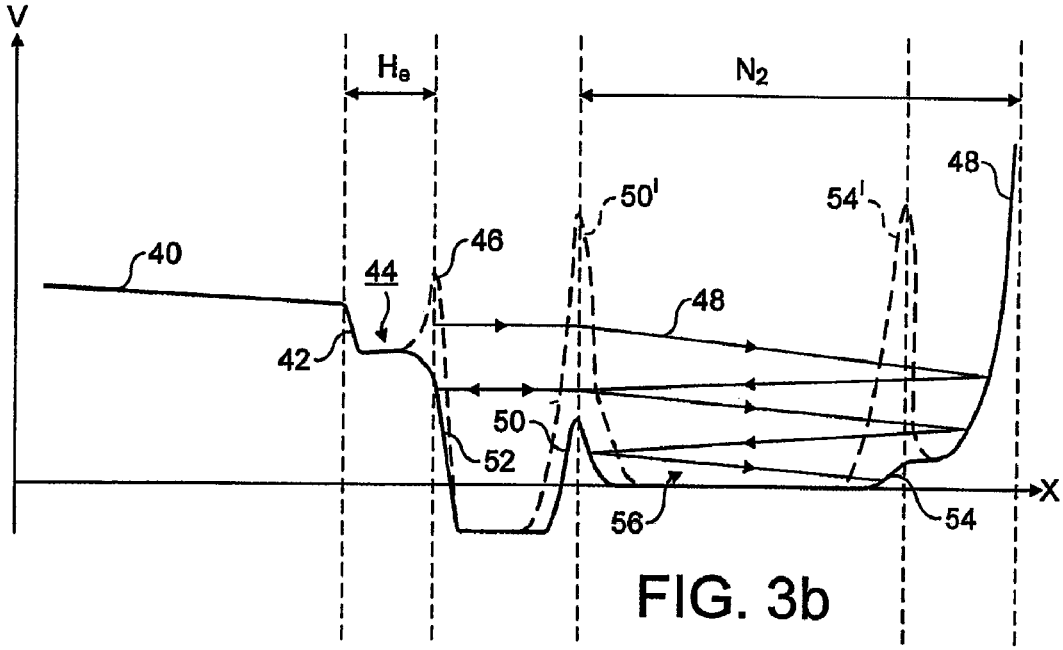
FIG. 3*b* shows the potentials placed on the ion trapping assembly in use.
Figure 3A:
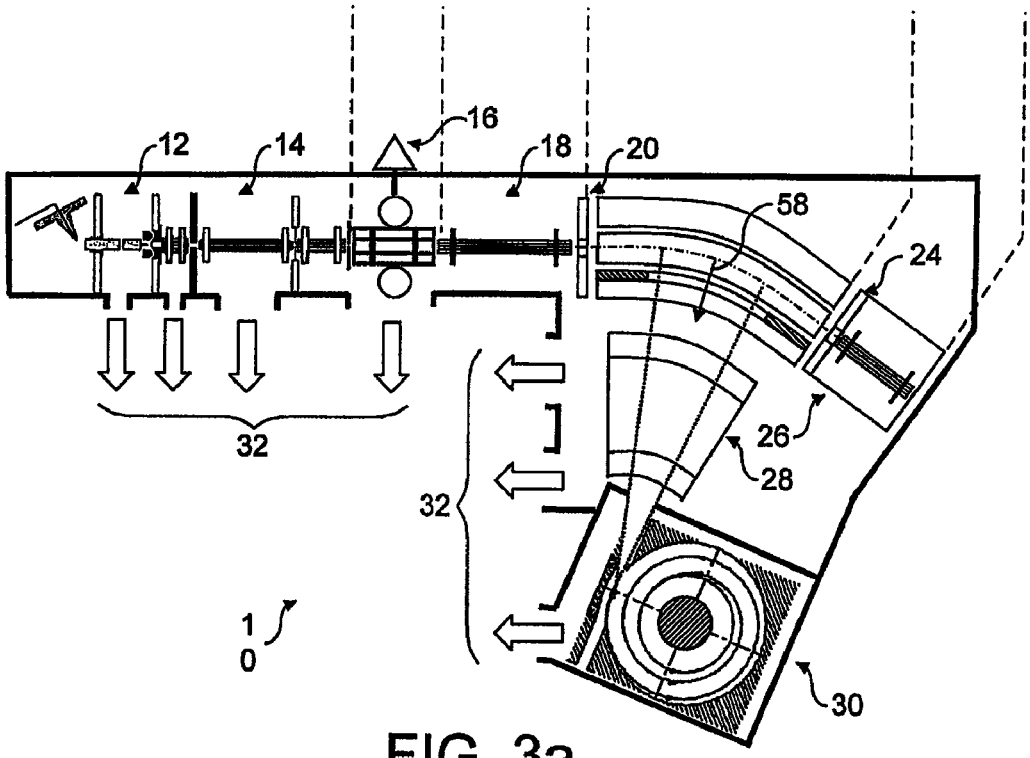
FIG. 3*a* shows an Orbitrap-type mass spectrometer including an ion trapping assembly according to an embodiment of the present invention.

A mass spectrometer 10 of the Orbitrap type is shown in FIG. 3*a*, although not to scale. The mass spectrometer 10 is generally linear in arrangement, with ions passing along the longitudinal (z) axis. The front end of the spectrometer 10 comprises an ion source 12. The ion source 12 may be chosen from the variety of well-known types as desired, for example electrospray, MALDI or any other known type. Ion optics 14 are located adjacent the ion source 12, and are followed by a linear ion trap 16. Further ion optics 18 are located beyond the ion trap 16, followed by a curved quadrupolar linear ion trap 22 bounded by gates 20 and 24 at respective ends. This ion trap 22 is the target ion trap in the sense that ions are accumulated here prior to subsequent ejections for mass analysis. An ion reflector 26 is provided adjacent the downstream gate 24. The ion optics 18, ion trap 22 and ion reflector 26 comprise an ion trapping assembly, each of these elements corresponding to a separate volume of that assembly.

The target ion trap 22 is configured to eject ions orthogonally in the direction of the entrance to an Orbitrap mass spectrometer 30 through an aperture provided in an electrode of the target ion trap 22 and through further ion optics 28 that assist in focussing the ion beam emergent from the ion trap 22.

In operation, ions are generated in the ion source 12 and transported through ion optics 14 to be accumulated temporarily in the ion trap 16. Ion trap 16 contains 1 mTorr of helium such that the ions lose some of their kinetic energy in collisions with the gas molecules.

Either after a fixed time delay (chosen to allow sufficient ions to accumulate in the ion trap 16) or after sufficient ions have been detected in the ion trap 16, ions are ejected from the ion trap 16 to travel through ion optics 18 and into the target ion trap 22. Ions with sufficient energy will pass through the target ion trap 22 into the ion reflector 26 where they are reflected to return back to the target ion trap 22. Depending upon the energy of the ions, they may be reflected by the gate 20 or, if they have enough energy to overcome the potential of the gate 20 and continue beyond, by the higher potential of the ion trap 16. This is explained in more detail below.

Cooling gas is introduced into the ion reflector 26 from where it may pass into the target ion trap 22. Nitrogen, argon, helium or any other suitable gaseous substance could be used as a cooling gas, although helium is preferred for the ion trap 16 and nitrogen for the ion trap 22 of this embodiment. This arrangement results in 1 mTorr of nitrogen in the ion reflector 26 and 0.5 mTorr of nitrogen in the target ion trap 22, i.e. the pressure is lower in the target ion trap 22 than in the reflector 26. The pumping arrangement used (indicated by the pumping ports and arrows 32) ensures that the ion optics 18 separating ion trap 16 from target ion trap 22 are substantially free of gas.

FIG. 3*b* shows the potential that exists along the ion path from ion source 12 to ion reflector 26. This potential is created by providing suitable voltages to electrodes present in the ion source 12, ion optics 14 and 18, ion traps 16 and 22, gates 20 and 24, and ion reflector 26. As can be seen, the ions start at a high potential in the ion source 12 and follow a potential that generally decreases to its lowest value in the target ion trap 22, thereby forming a potential well that traps ions as desired in the target ion trap 22.

In fact, the lowest potential is seen in the ion optics 18. As there is no gas within the ion optics 18, ions merely fly through the ion optics 18 without losing energy. Thus, the potential of the ion optics 18 is optimised to ensure minimal ion losses as they pass therethrough. In this case, the potential of the ion optics 18 is less than that of the ion trap 22, such that a raised potential is required therebetween to ensure ions trapped in the target ion trap 22 do not escape to the ion optics 18.

Ions generated by the ion source 12 follow the potential gradient 40 to be trapped in a potential well 44 formed in the ion trap 16 by a higher potential 46 placed on its far end and a drop 42 in potential at its near end. The ions so trapped may lose energy in collisions with the helium in the ion trap 16. Ion trap 16 may also include a detector operable to perform mass analysis experiments.

When sufficient ions have accumulated in the ion trap 16, they are released by lowering the potential 46 from that shown by the dashed line of FIGS. 3*b* to that shown by the solid line. Once the ions exit the ion trap 16 and the process of their subsequent storage in ion trap 22 is completed, the potential 46 is increased to correspond to the dashed line. After that, the trap 16 will be ready for filling again. Alternatively, the DC offset of the entire ion trap 16 could be raised, thus stopping ions from re-entering ion trap 16. It is also possible to use ion trap 16 in the transmission mode only, i.e. with potential 46 shown by the solid line set constantly.

A general path of an ion leaving ion trap 16 is shown at 48. The ion traverses the ion optics 18 and target ion trap 22 to enter the ion reflector 26, losing kinetic energy as it goes through collisions with the nitrogen present in the target ion trap 22 and ion reflector 26.

Eventually, the ion will be reflected by the very large potential 48 placed on the ion reflector 26. As can be seen, the potential in ion reflector 26 is arranged to rise exponentially. The once reflected ion again traverses the target ion trap 22 and, because its kinetic energy exceeds the potential 50 on gate 20, continues into ion optics 18 to be reflected by the steep potential gradient 52 between ion trap 16 and ion optics 18. If energy losses in the ion trap 22 and the ion reflector 26 were small enough, the ion could even reenter ion trap 16, lose some energy in collisions with gas and get reflected by potential barrier 42. Thus, the ion is sent back to the target ion trap 22 to be reflected once more by the potential 48 placed on the ion reflector 26. The ion is reflected back through the target ion trap 22 to be reflected once more by the potential 48 placed on the ion reflector 26.

In FIG. 3*b*, the thrice-reflected ion again traverses the target ion trap 22 but has now lost so much energy in collisions with gas molecules that it cannot surmount potential barrier 50 on gate 20. Thus, the ion is reflected back into the target ion trap 22. The potential of gate 24 and the entrance to ion reflector 26 is slightly higher than target ion trap 22: the ion is reflected by the resulting potential gradient 54, thereby becoming trapped within the potential well 56 of the target ion trap 22 that is formed between the gates 20 and 24.

Ions may be accumulated in the target ion trap 22 using only a single or continuous injection of ions, from ion trap 16. Alternatively, more ions may be accumulated in the target ion trap 22 by using two or more injections from the ion trap 16. This may be achieved through appropriate gating of the potential 46 placed on the end of ion trap 16.

Once ions are accumulated in the target ion trap 22, they could be manipulated in many different ways, for example:

Ions could be transferred back to the ion trap 16 and further processed, e.g. detected on its detector or fragmented, etc. (see below).

Ions could be transferred further downstream past ion reflector 26 to further mass analysers or fragmentors, etc.

Ions could be pulsed out from to the axis of the target ion trap 22 towards a mass analyser, e.g. orbitrap 30.

For the latter purpose, the potentials 50 and 54 may be raised to those indicated by the dashed peaks 50' and 54' to force the ions towards the middle of the trap 22. Increase of ion energy during such "squeezing" is quickly dissipated in collisions with gas in the target ion trap 22.

Ions accumulated in target ion trap 22 are ejected towards the centre of its curvature as indicated by arrow 58, either through the space between electrodes or through an aperture provided in an electrode. Ejection is facilitated using the method described in WO 05/124821A2 and incorporated herein in its entirety. Bunching the ions as described above reduces the width of the ion beam passing through the aperture. The curvature of the target ion trap 22 acts to focus the ions on the entrance aperture of the Orbitrap mass spectrometer 30, and this focusing is assisted by ion optics 28.

The above embodiment provides a pressure gain in that the multiple reflections allow a lower gas pressure to be maintained within the target ion trap 22 to provide the same collisional damping. This pressure gain is approximately equal to the number of reflections and this, in turn, is approximately equal to 0.3 to 0.5 divided by the fraction of ions lost from the ion trapping assembly per pass. The majority of ion losses in any ion trapping assembly are at the apertures provided in the electrodes that generally separate the volumes. Therefore high-transmission ion optics are important for optimum performance, particularly with respect to the aperture-defining electrodes. With other trapping regions also participating in ion cooling, pressure gain could be significantly higher if those regions have higher gas pressures than that in the target ion trap 22.

Preferably, the ion optics should be capable of transporting ions of widely varying energies, such as RF guides and periodic lenses. It has been found experimentally that low ion losses are achieved for RF multipoles of inscribed radius $r_0$ separated by apertures with inner radius exceeding 0.3 to 0.4 of $r_0$ and a thickness much less than $r_0$.

For example, in the above embodiment, the linear trap 16 is typically 50 to 100 mm long, the ion optics 18 are approximately 300 mm long, the target ion trap 22 has an axial length of about 20 mm, and the ion reflector 26 has a length of around 30 mm. The target ion trap 22 contains nitrogen at 0.5 mTorr giving a P×D=0.01 mm Torr, the ion reflector contains nitrogen at 1 mTorr giving a P×D=0.03 mm Torr.

The internal diameters of the apertures provided in gates 20 and 24 are 2.5 to 3 mm, while their thicknesses are no more than 1 mm. Inscribed diameters of the linear ion trap 16 is 8 mm, of the target curved linear ion trap 22 is $2\times r_{clt}=6$ mm, and of the ion optics 18 is 5.5 mm. Typically, trapping occurs on the timescale of few ms.

Overall, a low pressure in the target in trap 22 is desirable to allow safe pulsing-out of fragile ions orthogonally, as well as for more efficient differential pumping on the way to Orbitrap mass analyser 30. To avoid fragmentation of ions at high energies, $P_{clt}*r_{clt}<10^{-3}$ to $10^{-2}$ mm Torr is required (depending on mass, charge, structure and other parameters of ions). With $r_{clt}=3$ mm, this means $P_{clt}<(0.3 \text{ to } 3)\times10^{-3}$ Torr.

The pressure gain provided by the above embodiment has been seen to improve performance. Previously, a noticeable performance loss was observed in ion traps above m/z 500: now, no loss in performance is observed up to m/z 2000.

The above described embodiment is but merely one possible implementation of the present invention. The reader skilled in the art will appreciate that variations to this embodiment are possible without departing from the scope of the present invention.

Figure 4A:
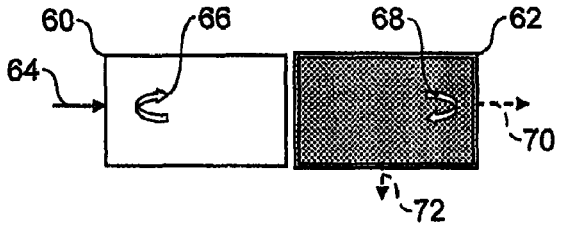
FIGS. 4*a* to 4*e* show schematically five embodiments of ion trapping assemblies according to the present invention.

For example, FIGS. 4*a* to 4*e* show different arrangements of ion optics and ion traps that may be used. FIG. 4*a* shows a simple ion trapping arrangement of ion optics 60 followed by a target ion trap 62. Ions are generated by an ion source (not shown) to be injected into the ion optics 60 at 64. The ions are reflected at the ends of the ion trapping arrangement, as indicated by arrows 66 and 68. Target ion trap 62 contains a gas to effect gas-assisted trapping. Ion optics 60 are kept at a higher potential than that of ion target trap 62. Ions that become trapped in the potential well of target ion trap 62 may be ejected either axially as indicated at 70 or orthogonally as indicated at 72.

Figure 4B:
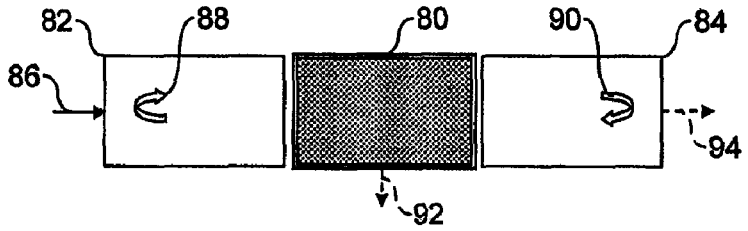

FIG. 4*b* shows an ion trapping arrangement comprising a target ion trap 80 sandwiched between two sets of ion optics 82 and 84. Ion optics 84 act as an ion reflector. Ions are injected at 86 to be reflected by the ends of ion optics 82 and 84, as indicated at 88 and 90. The target ion trap 80 contains a gas. Trapped ions collect in a potential well formed by the target ion trap 80 and may be ejected orthogonally at 92 or axially via the ion optics 84, as indicated at 94.

Figure 4C:
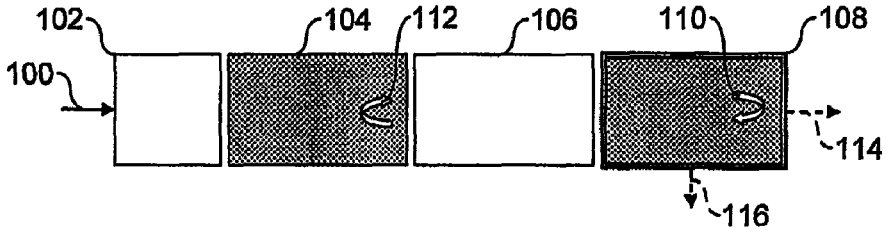

FIG. 4*c* shows an ion trapping arrangement where ions injected at 100 pass through ion optics 102, gas-filled ion trap 104, ion optics 106 and gas-filled target trap 108 in turn. Ions are reflected by the far end of target trap 108 at 110 and by the far end of ion traps 104 at 112. Ions trapped in the potential well provided by the target ion trap 108 may be ejected either axially at 114 or orthogonally at 116.

Figure 4D:
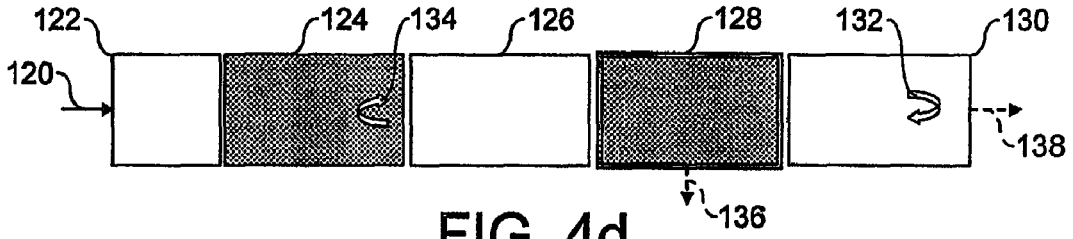

FIG. 4*d* shows an ion trapping arrangement where ions injected at 120 pass through ion optics 122, gas-filled ion trap 124, ion optics 126, gas-filled target ion trap 128 and ion reflector 130. Ions are reflected by ion reflector 130 at 132 and the far end of ion trap 124 at 134. Ions trapped in the potential well provided by the target ion trap 128 may be ejected either orthogonally from the trap 128 at 136 or axially via ion reflector 130 at 138.

Figure 4E:
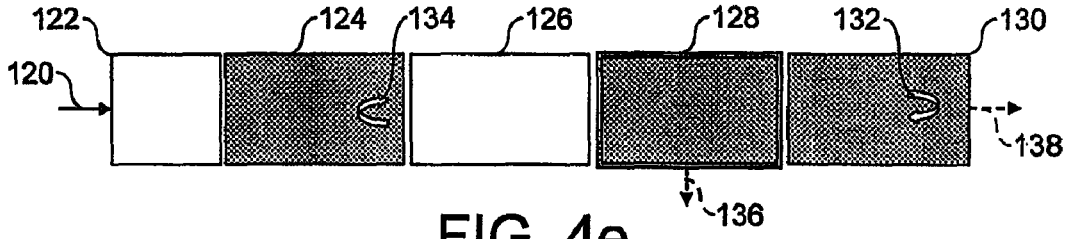

FIG. 4*e* corresponds substantially to FIG. 4*d*, except that both target ion trap 128 and ion reflector 130 are filled with gas. Thus, the ion trapping arrangement of FIG. 4*e* is the same as that shown in FIG. 3*a*. It is important to notice that in all embodiments of the current invention, collisions on a single ion pass through the target ion trap 22 result in capture of a substantially negligible proportion of the ion beam, typically <10%. Applying the invention, capture efficiency improves as compared to a single-pass by at least 2-5 fold. This distinguishes this invention from numerous known types of single- and multiple-trap arrangements.

The described principle of trapping is applicable to any type of traps regardless of their construction and thus includes: extended sets of electrodes or multipoles, apertures of constant or varying diameters, spiral or circular electrodes with RF and DC applied potentials, magnetic and electromagnetic traps, etc. While the use of gas-assisted trapping is preferred, other arrangements such as adiabatic trapping may also be employed. Also, ion trap potentials may be increased to effect ion cloud compression within the ion trap.

Where gas-assisted trapping is being used, the choice of gases that are used may be freely varied, as may the pressures at which these gases are maintained. Reactive gases (such as methane, water vapour, oxygen, etc.) or non-reactive gases (such as noble gases, nitrogen, etc.) could be also used when desired.

Other uses of proposed trapping method might be envisaged. For example, the arrangement of FIG. 3*a* or FIG. 4*b* could be used to increase the trapping efficiency of incoming ions from the ion source 12 without the need for increasing the length (and thus the cost) of the ion trap 16 or 104, respectively. In this case, most of ions could be trapped in the target trap 22 or 108 initially, and subsequently transferred back to the ion trap 16 or 104.

Generally, ions could be moved from one ion trap to another just by changing DC offsets on the ion traps 16 and 22, and ion optics 14 and 18. In this sense, the term "target trap" should be construed to mean the target for where the ions are to be trapped using collisional cooling (as opposed to the final ion trap used for storage prior to mass analysis). This also allows diagnostics and minimisation of ion losses. For example, a fixed number of ions could be transferred from ion trap 16 into ion trap 22, then back into ion trap 16 and then measured using a detector or detectors provided in the ion trap 16. Comparison of mass spectra collected by the same detector(s) with and without transfer to the ion trap 16 allows accurate measurement of ion transmission for each mass peak.

Another possibility opened by multi-pass trapping is the splitting of ion beams. For example, if two ion traps have exactly the same DC offset and no potential barriers separating them, the ion cloud will be distributed between these traps. Creating a potential barrier between the ion traps would split the ion population in two. This could be useful when different detectors are employed in each of the traps as it would allow better cross-calibration of each detector and better quantitative analysis. For example, a first part of the ion population could be split into a first part of the target ion trap 22 and trapped there before being measured by an associated detector. The measured ion number could be then used for predicting the exact number of ions stored in the second part of the target ion trap 22 that may be subsequently ejected to the orbitrap 30. This allows corrections to be applied to the mass calibration in mass spectra acquired in the orbitrap 30. This would be advantageous when used with relatively unstable sources, such as MALDI.

As any of the ion traps within the embodiments described above could be operated as the target ion trap if potentials are set appropriately, it means also that each of the ion traps could be interfaced to another mass analyser either axially or orthogonally, as shown schematically by dashed arrows in FIG. 4. Such mass analysers are preferably of TOF, FT ICR, electrostatic trap or any ion trap types, but quadrupole mass analysers, ion mobility spectrometers or magnetic sectors could also be used. Mass analysers could form an integral part of any ion optics shown in FIG. 3 or 4.

The above has been described in the context of trapping positive ions. However, the skilled person will appreciate that the present invention lends itself just as readily to trapping negative ions. Although adaptation of potentials (polarities in particular) will be required, such adaptation is straightforward and well within the skill of the ordinary skilled person.

In fact, the present invention may be used to trap ions of both polarities simultaneously, provided that potential barriers are used that can trap both polarities. Such potential barriers may be created by the "pseudo-potential" (otherwise known as the "effective potential") of RF fields (similar to an RF field that holds ions of any polarity in an ion trap). For example, an RF voltage may be applied to apertures at the end(s) of the target trap 22, or there may be an RF voltage between offsets of two multipoles, etc.

When ions move in RF fields, their motion may be considered as a high-frequency ripple at the frequency of the RF field, superimposed on a smooth "averaged" trajectory. As shown by Landau and Lifshitz (Mechanics, Pergamon Press, Oxford, UK, 1969), the motion of ions with a mass-to-charge ratio m/q along such "smoothed" trajectories is equivalent under certain conditions (e.g. when the ripple is relatively small) to the motion in the pseudo-potential:

$$U_{eff}(r, z) = \frac{1}{2 \cdot m/q} \cdot \left\langle \left| \int_t \nabla \Phi dt \right|^2 \right\rangle$$

where <. . . > means averaging over the period of the RF field, | . . . | means the modulus of the vector, and $\nabla\Phi$ is the gradient of the RF potential. Pseudo-potentials may be used to create potential wells or barriers as effectively as DC potentials. The pseudo-potential is proportional to the average of the field gradient squared and inversely proportional to m/q, and so will exhibit strong mass dependency. The strong mass dependency of pseudo-potential could be used to advantage when mass selection is required. The major difference is that pseudo-potential wells or barriers work in the same way on both negative and positive charged particles, thus allowing ions of both polarities to be trapped simultaneously. Pseudo-potentials may also be combined with DC potentials. Obviously, pseudo-potentials could be also used to trap ions of one polarity only.

In the embodiments above, an RF voltage could be switched on at the end apertures of the target trap 22 or even between RF multipoles (e.g. on top of a DC offset of a multipole) when ion trapping is required. As an example, positive ions could be stored near one end of the target trap 22 using only DC potential wells. Then negative ions could be admitted from an additional ion source or even from the same ion source 12 (after voltage polarity is reversed along all of the ion path except the target trap 22) and stored near the other end of the target trap 22. Ions may be introduced from further ion sources. After that, RF is switched on at both ends of the target trap 22 and DC potential wells are removed. Ions of both polarities start to share the same trapping volume and attract to each other resulting in ion-ion interactions for example as described in WO 2005/090978 and WO 2005/074004.

The invention claimed is:

1. A method of trapping and reacting ions in a target ion trap comprising:

introducing ions of a first type into an ion trapping assembly comprising a series of volumes arranged such that the ions of the first type can traverse from one volume to the next, the volumes including the target ion trap and a second volume;

allowing the ions of the first type to pass into and out from the target ion trap without being trapped;

causing the ions of the first type passing out from the target ion trap to enter the second volume, to be reflected from an end of the second volume, and to pass out of the second volume without being trapped in the second volume;

guiding the ions of the first type passing out of the second volume such that they pass into the target ion trap for a second time;

introducing ions of a second type into the target ion trap, the ions of the second type having a polarity opposite to the polarity of the ions of the first type;

simultaneously confining the ions of the first and second types within the target ion trap; and allowing the ions of the first and second types to mix.

2. The method of claim 1, wherein the step of simultaneously confining the ions includes generating a pseudo-potential.

3. The method of claim 2, wherein the step of generating a pseudo-potential includes applying RF voltages to electrodes of the target ion trap.

4. The method of claim 3, wherein the RF voltages are applied to lenses positioned at opposite ends of the target ion trap.

5. The method of claim 1, further comprising steps of:

establishing a first DC potential well to confine the ions of the first type within a first portion of the target ion trap;

establishing a second DC potential well to confine the ions of the second type within a second portion of the target ion trap, the first and second portions being spatially separated; and wherein the step of allowing the ions of the first and second types to mix includes removing the first and second DC potential wells.

6. The method of claim 2, wherein the pseudo-potential is generated after the ions of the first and second types have been introduced into the target ion trap.

7. The method of claim 2, wherein the pseudo-potential is generated along the longitudinal axis of the target ion trap.

* * * * *